US005763040A

United States Patent [19]

Murphy et al.

[11] Patent Number: 5,763,040

[45] Date of Patent: Jun. 9, 1998

[54] RUG AND CARPET UNDERLAYS SUBSTANTIALLY IMPERVIOUS TO LIQUIDS

[75] Inventors: Peter Michael Murphy, Ooletwah, Tenn.; Edward James Greenwood; Joyce Monson Materniak, both of Hockessin, Del.

[73] Assignee: E. I. du Pont de Nemours and Company, Wilmington, Del.

[21] Appl. No.: 718,126

[22] Filed: Sep. 18, 1996

Related U.S. Application Data

[63] Continuation-in-part of Ser. No. 424,754, Apr. 18, 1995, Pat. No. 5,601,910.

[51] Int. Cl.[6] ..... B32B 3/02

[52] U.S. Cl. ..... 428/96; 428/95; 428/97; 442/79; 442/80; 442/81; 442/82; 442/84

[58] Field of Search ..... 428/95, 96, 97; 442/79, 80, 81, 82, 84

[56] References Cited

U.S. PATENT DOCUMENTS

| | | | |
|---|---|---|---|
| 2,225,906 | 12/1940 | Dallia | 154/49 |
| 3,923,715 | 12/1975 | Dettre et al. | 260/29.6 R |
| 4,014,645 | 3/1977 | Chancler et al. | 8/17 |
| 4,029,585 | 6/1977 | Dettre et al. | 252/8.6 |
| 4,206,007 | 6/1980 | Force | 156/72 |
| 4,234,649 | 11/1980 | Ward | 428/255 |
| 4,360,554 | 11/1982 | Campbell et al. | 428/91 |
| 4,412,877 | 11/1983 | Vosburgh | 156/72 |
| 4,595,518 | 6/1986 | Raynolds et al. | 252/8.6 |
| 4,619,853 | 10/1986 | Blyth et al. | 428/95 |
| 4,742,140 | 5/1988 | Greenwood et al. | 526/245 |
| 4,958,039 | 9/1990 | Pechhold | 556/421 |
| 5,344,903 | 9/1994 | Raiford et al. | 526/245 |
| 5,348,785 | 9/1994 | Vinod | 428/95 |

FOREIGN PATENT DOCUMENTS

| | | | |
|---|---|---|---|
| 520308 | 7/1955 | Belgium . | |
| 333 396 | 9/1989 | European Pat. Off. | D06N 7/00 |
| 2 576 506 A1 | 8/1986 | France . | |
| 518 890 A | 3/1940 | United Kingdom . | |
| WO 96/33307 | 10/1996 | WIPO . | |

*Primary Examiner*—Christopher Raimund

[57] ABSTRACT

A carpet underlay comprising a fibrous nonwoven substrate composed of natural or synthetic fibers having in or on it a repellent finish which makes said substrate substantially imprevious to liquids, and a carpet having an underlay substantially impervious to liquids affixed to the carpet back rendering said carpet substantially impervious to liquids are disclosed.

9 Claims, No Drawings

RUG AND CARPET UNDERLAYS SUBSTANTIALLY IMPERVIOUS TO LIQUIDS

RELATED APPLICATIONS

This is a Continuation-in-Part of application Ser. No. 08/424,754 filed Apr. 18, 1995, now U.S. Pat. No. 5,601,910.

FIELD OF THE INVENTION

This invention relates to novel rug and carpet underlays that are substantially impervious to liquids.

BACKGROUND OF THE INVENTION

Area rugs, for instance Oriental rugs, are commonly laid over wall-to-wall carpeting or other carpets, or over decorative wood flooring, to achieve desired esthetic effects. When such rugs are laid over carpets the rug may tend to slip or move in one direction due to the alternating compression and release of the fibers in the underlying carpet caused by normal traffic. Thus the rug and furnishings placed on it move from their desired position. Additionally the rug may become creased or wrinkled instead of flat. Such rugs may also slip on the polished surfaces of a decorative wood floor. Such movements detract from the esthetics of the room and may cause slipping and tripping risks.

Rug underlays have been proposed as a solution to such problems, for instance the rug underlays disclosed by Mussallem in U.S. Pat. No. 4,504,538 and U.S. Pat. No. 4,985,279. The underlay typically consists of a light-weight nonwoven mat, comprised of filamentary fibers, needle-punched into a coarse thin mat. Needle-punching is commonly used to compress fibrous mats into a felt-like material. Mussallem discloses that any natural or synthetic fiber may be used in the underlay, but that synthetic fibers such as polyolefin, nylon, polyester, acrylic polymers, etc., are preferred. Needle-punching can also be used to embed a woven mesh in such a nonwoven mat to strengthen and stiffen the mat. The needle-punched mat is then treated with an emulsion adhesive, such as a synthetic rubber latex, on at least one side and preferably both sides. The adhesive is then cured. The adhesive properties of the underlay effectively secures it to the underlying rug or underlying surface and prevents movement. The underlay adhesive coating is selected to provide both the necessary adhesive strength to prevent slippage or movement and a sufficiently low peel strength so that the rug may be easily and reversibly removed from the underlying surface for cleaning or other purposes.

If water-based or oil-based liquids are spilled on a rug or carpet placed over a carpet or decorative wood floor, the underlying material may become stained and deteriorate. Water-based spills may also transfer dyes from the rug to the underlying material. Other water-based spills may contain colored materials, e.g., colored drinks or coffee, or contain other undesirable components which can soak through to the underlying material. Oil-based liquids, e.g., mineral oil, baby oil, kerosene, or alcohol, may penetrate to the underlying material with potential undesirable effects. Cleaning aids applied to the rug may similarly pass through the rug and adversely affect the underlying material. Oil-in-water emulsions, e.g., milk or lotions, and water-in-oil emulsions, e.g., dairy spreads, are examples of spills requiring a barrier substantially and simultaneously impervious to both water-based and oil-based spills.

Broadloom carpeting, typically used for fitted or wall-to-wall carpeting, may be laid over substrates where the appearance of the substrate is to be preserved. Broadloom carpeting is typically constructed with a primary backing to which the carpet tufts are attached by means of a latex adhesive. Such carpeting with a latex adhesive and single backing is termed "unitary" carpeting. Most broadloom carpeting also has a secondary backing of an open weave fabric (weave spacing about 0.6–0.9 cm (0.25–0.375 inches), impregnated with the latex, which provides dimensional stability and a finished appearance to the back of the carpet. While the open weave of the secondary backing fabric itself cannot be made impervious to liquids, U.S. Pat. No. 5,348,785 discloses a method to render the latex-impregnated secondary backing of a carpet substantially impervious to liquids by treatment with repellent compositions, such as fluorochemicals, silicone-based compositions, oils, waxes, and/or hydrophobic acrylate resins. Typically area and Oriental rugs are not treated by such processes and are therefore permeable to liquids Similarly, carpets used for fitted or wall-to-wall carpeting may be laid over substrates where the appearance of the substrate is to be preserved. While such carpets are not prone to the movement or slipping hazards of rugs, staining of the substrate can result from spills. Such staining is particularly insidious since detection and prevention of the staining following a spill is typically impractical with large or fitted carpets. A spill on broadloom carpeting often puddles on the padding or subflooring where it can not be removed by cleaning. This spill then accelerates the growth of mold, mildew and odors. By allowing spills to be more thoroughly cleaned, a water impermeable backing reduces the growth of mold and mildews which cause odors.

The prior art also describes water-impermeable carpeting constructed using impervious backings such as those based on poly(vinyl chloride) and polyurethane. However, such backings are expensive and create manufacturing difficulties It is desirable that a treatment be applied to the underlay which would create a substantially impervious barrier to liquids between the rug or carpet and the underlying material. Such a treatment must not interfere with the adhesive surfaces of the underlay, and ideally would be readily incorporated into the manufacturing process for the underlay. It is also desirable to have a carpet backing which is substantially imprevious to liquids. The present invention provides such an underlay and carpet having such a backing.

SUMMARY OF THE INVENTION

This invention relates to rug or carpet underlays which are substantially impervious to liquids, such as oil and water, and methods of preparing the same. The underlays are also oil-repellent and water-repellent.

The present invention comprises a tufted pile carpet comprising: a) a primary backing having a surface tufted with pile yarns and an underside to which a water permeable latex has been applied; b) an optional water permeable secondary backing having a surface and an underside, wherein the surface of the secondary backing is adhered to the underside of the primary backing; and c) an underlay having a surface and an underside, wherein the surface of said underlay is affixed with an adhesive to the underside of either the secondary backing or the primary backing, and said underlay comprises a nonlatex fabric, said fabric being substantially impervious to liquids, wherein said carpet is substantially impervious to liquids.

DETAILED DESCRIPTION OF THE INVENTION

This invention provides underlays and carpet backing with one or more adhesive surfaces having repellent finishes, whereby the underlays and backing are substantially impervious to oil-based and/or water-based liquids. The process of this invention for making the underlay or backing liquid impervious is readily incorporated into the manufacturing processes for underlays.

The term "repellent finish", as used herein, means a composition containing oil- and/or water-repellent chemicals dispersed, dissolved, or suspended in a solvent such as water or alcohol which will form a film-like barrier on or in the underlay to render the same substantially impervious to liquids. The repellent finish optionally contains surfactants, foaming agents, and other additives. In addition the repellent finish can contain a mixture of different repellents. Suitable repellents for use in the repellent finish are selected from the group consisting of fluorochemicals, silicone compositions, wax emulsions, naturally-occurring oils, hydrophobic alkylacrylate resins, and hydrophobic alkylmethacrylates resins.

By the term "liquids" is meant oil-based and/or water-based liquids.

By the phrase "substantially impervious to oil-based liquids" is meant that, in addition to being substantially impervious to water, non-aqueous liquids (e.g., mineral oil or alcohol) will not substantially penetrate through the underlay in accordance with the Test Method 1 described below.

By the phrase "substantially impervious to water" is meant that water or aqueous solutions or aqueous suspensions (e.g., coffee, wine, soda, fruit juices, or urine) will not substantially penetrate through the underlay in accordance with the Test Method 2 described below.

By the term "substantially impervious to liquids" is meant that 20 ml of liquid poured on the underlay from a height of 6 cm makes no wet spot after 30 minutes, or a wet spot having a diameter of no more than 2.54 cm, on a paper towel located directly beneath the location of the underlay on which the liquid has been poured.

By the term "water permeable" is meant that when the above test is performed a wet spot having a diameter of greater than 2.54 cm is obtained.

Generally the mat for the underlay of this invention is prepared by conventional techniques. The underlay typically consists of a light-weight nonwoven mat, comprised of filamentary fibers, and is needle-punched into a coarse thin mat. Any natural or synthetic fiber is used to make the underlay, but fibers such as polyolefin, nylon, polyester, wool, cotton, jute, acrylic polymers, and the like are suitable. The fibers are woven, nonwoven, knitted or stitch-bonded. Optionally a woven mesh is incorporated into the mat. Such methods and materials are well known to those skilled in the art. While the underlay mat has been described with respect to certain embodiments, many modifications and changes may be made by those skilled in the art. Similarly many methods for the continuous production of underlay and the coating of the underlay are well known to those skilled in the art. It is intended that all such modifications and production methods are included in the meaning of the term "underlay mat" as used herein.

The underlay of this invention is sufficiently substantial and underlays of less than about 40 to 50 g/m$^2$ typically will provide repellency but may not be impervious to oil and water. The underlay of this invention may be described as a "tertiary" backing when affixed to a carpet, and is applied to unitary carpeting and carpeting with a secondary backing. The underlays of this invention are applied to carpets and rugs that do not already have a water-impermeable backing such as the poly(vinyl chloride) and polyurethane backings described above. Typically the underlays of this invention are applied to carpets having a latex coated primary backing such as styrene-butadiene rubber based latex (SBR) or ethylene vinyl acetate based latex (EVA), and where the unitary carpet or secondary backing has not been treated with oil or water repellant finishes.

The underlays of this invention are useful as a separate underlay under an area rug or affixed to the backing of a carpet to provide imperviousness to liquids, and provide several advantages over the prior art. The underlays provide a more complete, durable, and permanent repellency and imperviousness to liquids since the fluorocarbon treatment has more affinity for the underlay material than for the latex-treated primary or secondary backing, where incompatibilities between the fluorocarbon treatment agent and the latex can occur. Thus the uniformity of application eliminates untreated areas through which spills can pass. The underlay of this invention is applied separately from the carpet manufacture, eliminating a production holdup for an extra drying step and enabling the underlay to be applied to desired areas of carpet, rather than throughout a manufacturing run. The drying of carpet is typically the production-limiting step. The underlay of this invention can be applied independantly of the carpet production, for instance, at the installation site. Furthermore, the applied underlay improves the cushioning of the carpet, contributing to reduced wear and improved feel and esthetics.

Suitable fluorochemicals for use herein include, but are not limited to, polymers or other compounds with molecular weight greater than 500 having pendent or terminal groups of perfluoroalkyl moieties. Examples of some suitable fluorochemicals include: polymers and copolymers of vinylidene fluoride, tetrafluoroethylene, perfluoroalkylethyl acrylates, perfluoroalkylethyl methacrylates, mixtures of the same; blends of the foregoing polymers and copolymers with polymers and copolymers of alkyl acrylates and alkylmethacrylates, copolymers of vinylidene chloride, vinylidene fluoride, tetrafluoroethylene, perfluoroalkylethyl acrylates and perfluoroalkylethyl methacrylates and wax emulsions.

Many commercially available fluorochemicals are used both as repellent finishes and as effective oil-repellents and water-repellents. These include for example, commercially available proprietary products sold under the tradenames of "TEFLON" and "ZONYL" from E. I. du Pont de Nemours and Company, Wilmington, Del.; "MILEASE" from ICI, Wilmington, Del.; "ASAHIGARD" from Asahi Glass, Plymouth, Mich.; "SCOTCHGARD" from 3M, Minneapolis, Minn.; "SOFTECH" from Dyetech, Dalton, Ga.; "TEX-TEL" from Atochem, Philadelphia, Pa.; and "NK GUARD" from Nicca, Fountain, S.C. which are suitable for use herein. Suitable commercially available silicone-based repellents include, but are not limited to, C2-0563 from Dow Corning, Midland, Mich. Dow Corning C2-0563 is a silicone repellent mixture of polydialkylsiloxanes. Suitable commercially available wax emulsions include, but are not limited to those sold under the trademark "NALAN" from DuPont, and "OCTOWAX" 312 from Tiarco Chemical Co, Dalton, Ga. Suitable hydrophobic acrylate resins include water-repellent polymers and copolymers of acrylic acid esters and methacrylic acid esters such as the methyl, but preferably ethyl and butyl, esters. Mixtures of these polymers and copolymers are also effective. One example of a commercially available resin is "Acrylic Matte Medium" from Golden Artist Colors, Hamilton, N.Y.

Certain repellent finishes as used in this invention provide an underlay that is substantially impervious to water-based spills. Other repellent finishes provide an underlay that is substantially impervious to liquid spills, including both oil-based and water-based spills. Thus the repellent finish is selected based on the desired type of imperviousness. Since the repellent finishes for water are typically less expensve than those for liquids, selecting a repellent finish that provides an underlay substantially impervious only to water based spills can be preferred for certain environments.

Preferred fluorochemical repellent finishes include the following aqueous dispersions: a polyf luoro organic compound prepared by reacting a polyisocyanate with a fluoroalcohol and water disclosed in EP A453641 (Repellent A of the Examples herein); a blend of a fluoroalkyl citrate-urethane and polymethylmethacrylate disclosed in U.S. Pat. No. 3,923,715 (Repellent B of the Examples herein); a fluorocarbonylimino biuret obtained by reacting polyisocyanate with a fluoroalcohol and monochlorohydrin disclosed in U.S. Pat. No. 4,958,039 (Repellent C of the Examples herein); a blend of a fluoroalkyl citrate urethane, a fluoroalkyl methacrylate/2 -ethylhexyl methacrylate/2 - hydroxyethyl meth-acrylate/N-methylolacrylamide copolymer, a fluoroalkyl methacrylate/lauryl methacrylate/N-methylolacrylamide copolymer, a dimethylaminoethyl methacrylate/acrylic acid copolymer, and a chloroprene/dichlorobutadiene copolymer disclosed in U.S. Pat. No. 4,595,518 (Repellent D of the Examples herein); copolymers of an alkyl (meth)acrylate/f luoro-alkyl (meth)acrylate/vinylidene chloride disclosed in U.S. Pat. No. 5,344,903; and FC-1355 and FC-1367 (both anionic emulsions of fluoroaliphatic polymers, from 3M Company, Minneapolis, Minn.).

Fluorochemical repellent finishes containing solvents, exemplified by an aqueous dispersion of a copolymer disclosed in U.S. Pat. No. 4,742,140 comprising an alkyl acrylate or methacrylate, vinylidene chloride, and a mixture of fluoroalkyl alkyl methacrylates or acrylates (containing some acetone) are also effective in this application, but less preferred due to concerns over flammability hazards and the disposal of organic solvents. The preferred repellent finishes either contain no volatile organic solvents, or no more than about 1%.

Preferred mixed fluorochemical and hydrocarbon repellent finishes include a blend of wax, a diethylaminoethyl methacrylate/hexadecyl methacrylate/octadecyl methacrylate copolymer of the type disclosed in U.S. Pat. No. 4,595,518 and a fluoroalkyl acrylate/hexadecyl methacrylate/octadecyl methacrylate/vinylidene chloride copolymer disclosed in U.S. Pat. No. 4,742,140 (Repellent E of the Examples herein); a blend of wax, a diethylaminoethyl methacrylate/hexadecyl methacrylate/octadecyl methacrylate copolymer and a fluoroalkyl methacrylate/dodecyl methacrylate copolymer of the type disclosed in U.S. Pat. No. 4,595,518 (Repellent F of the Examples herein).

Preferred hydrocarbon water-repellent finishes include an aqueous dispersion of: a hydrocarbon wax and a behenic acid ester of melamine (Repellent G of the Examples herein); a hydrocarbon wax stearyl methacrylate/diethylaminoethyl methacrylate copolymer (Repellent H of the Examples herein); and "OCTOWAX" 321 (an aqueous paraffin wax emulsion, from Tiarco Chemical Co., Dalton, Ga.).

Results obtained using the preferred repellent finishes are described in the Examples. Suitable commercial repellent finishes after application, drying, and curing do not stain or transfer to the underlying substrate (e.g. the carpet or the floor).

Repellent finishes typically have an organic segment of the molecule that binds to the fiber. Those which show oil repellency may also have a fluorocarbon segment. The repellent finishes are selected in part based on the fiber composition. Typical mat fibers can range from relatively hydrophilic fibers such as nylon, intermediate fibers such as polyester, to relatively hydrophobic fibers such as polyolefins. The techniques for matching repellent finishes with fiber composition are well known in the art. Typically the repellent finish is diluted with water or a suitable solvent such as alcohol for application to the mat, with water being preferred. The necessary dilution is determined by the wet pick-up and the required concentration of active ingredient in the dried and cured mat. The wet pick-up is the amount of repellent finish in the wet mat after application but before drying or curing. The wet pick-up is expressed as a percentage based on the dry fiber. For instance, if a repellent finished mat is to contain 1.5% of the active ingredient and the wet pick-up is 200%, the repellent finish as applied should contain 0.75% active ingredient (100×0.015/2).

The amount of repellent finish, together with the necessary diluent such as water or alcohol that is applied to the underlay, is measured as wet pick-up prior to drying and curing. The wet pick-up applied to the rug underlay fabric will generally be in the range of 20 to 300% by weight, and preferably 50 to 200% by weight, based on the untreated underlay fabric. Typically, commercially available repellent finishes contain about 0.5 to about 40% by weight total active ingredient. In the case of silicones, the total active ingredient may be greater than 40% by weight. In this invention, the amount of active ingredient of repellent finish applied will generally be in the range of about 0.01 to 10% by weight, and preferably 0.05 to 3% by weight, of the active ingredient in the repellent finish based on the underlay mat.

However, it is understood that the amount of repellent finish and active ingredient applied will be adjusted depending on the type and concentration of the repellent, the underlay mat construction and weight, the type of fiber or fibers in the underlay mat, and the type of adhesive application. In any application, it is important that a sufficient amount of repellent finish be uniformly applied to the underlay mat such that the repellent finished underlay is substantially impervious to water or to liquids, according to Test Methods 1 and 2 described below.

The repellent finish is applied to the underlay mat by various means including foam, spray, dipping, or padding processes, followed by a heat treatment to dry or cure the repellent finish, typically in an oven. The drying temperature, drying temperature profile, and drying time are selected, based on the thermal stability of the fabric and the drying and curing properties of the repellent finish, to be sufficient to accomplish the necessary drying and curing. Control of such drying parameters are well known to those skilled in the art.

It is necessary to ensure that the repellent finish be completely and uniformly applied to the underlay mat, and completely and uniformly dried and cured. Padding, in which the underlay mat is dipped in a bath and the excess repellent finish squeezed off, typically gives excellent and uniform application and is thus the preferred application method. Foam and spray applications, on the other hand, can allow starved or missed areas unless the foam or spray is very carefully applied. Even very small undertreated areas will impair the imperviousness desired. To ensure foam and spray applications are complete, it may be necessary to apply the repellent finish with greater wet pick-up than would be necessary for padding. However, this can require the spray or foam repellent finish to be diluted with extra water compared with the padding process, thus requiring extra drying. For foam and spray applications, a wetting agent may be added to the repellent finish to assist in the complete and uniform application. Suitable wetting agents are exemplified by, but not limited to, "ALKANOL" 6112 (poly(oxyethylene sorbitan monooleate in water/1-decanol), from E. I. du Pont de Nemours & Company, Wilmington, Del.). Wetting agents were not necessary in the preferred pad application.

The undelay mat, now substantially impervious to water or liquids, is then coated with adhesives. For rug underlays the mat is coated on one, and preferably both, sides with a suitable adhesive, the adhesive is cured or dried, and one or both surfaces of the repellent finished underlay is protected by an easily released sheet of material, e.g., plastic, paper, or other inexpensive material, to prevent adhesion of the underlay to itself or other surfaces during handling, storage, transportation, and appropriately packaged. The adhesives suitable for underlays, the methods of adhesive application to underlays, and the packaging of underlays are well known to those skilled in the art. While the application of adhesive and packaging of the underlay have been described with respect to certain embodiments, many modifications and changes can be made by those skilled in the art. It is intended that all such modifications are included in the meaning of the term "repellent finished underlay mat" as used herein.

For carpet underlays, the mat is coated on one side with an adhesive. The preferred adhesives for laminating the water impermeable underlay to the underside or backing of wall-to-wall carpeting will (1) cure at ambient temperatures, (2) adhere the carpet underside to the impermeable backing immediately upon contact, (3) remain adhered to carpet underside and impermeable backing even when wet by liquids, and (4) provide a lamination strength of at least about 8.9 kg/m (0.5 lb/in), preferrably at least about 17.9 kg/m (1.0 lb/in). Examples of effective adhesives are "3M Super 77 Spray Adhesive", manufactured by 3M Industrial Tape and Specialty Division, St. Paul, Minn. Additional examples of effective adhesives include "Elmer's Spray Adhesive", Distributed by Borden Inc., Department HPPG Elmer's, Columbus, Ohio and "Liquid Nails Adhesive for Projects and Construction", Macco Adhesives, The Glidden Company, Cleveland, Ohio. Many other adhesives with these characteristics are well known in the art and are suitable for use herein.

The underlays of this invention preferably utilize fabric with loft or height characteristics dependent on the desired use. Fabric loft or height is important for a rug underlay between an area rug and wall-to-wall carpeting. The fabric height of between about 2 mm and 5 mm allows complete contact with each surface and maximizes the non-slip aspects of the rug underlay. A rug underlay fabric is also appropriate as a water impermeable backing on wall-to-wall carpeting. However, a fabric that does not contain about at least 2 mm of loft can nevertheless be an effective water impermeable backing on wall-to-wall carpeting. The adhesive insures that the water impermeable backing and the wall-to-wall carpeting are in complete contact. For ease of installation, the water impermeable backing does not provide a non-slip feature in wall-to-wall carpeting. So, a fabric with less than about 2 mm in height or loft is an effective water impermeable backing for wall-to-wall carpeting. To achieve a lofted fabric with between about 2 mm and 5 mm of height, a needlepunched nonwoven fabric is required. For water impermeable backings attached to wall-to-wall carpeting, woven, nonwoven, knitted, stitch-bonded or other fabrics are suitable such as fabrics made from polyethylene, polypropylene, polyolefin, acrylic fibers, polyester, polytrimethylene terephthalate, nylon, wool, cotton, jute, thermoplastic polymer films, mixtures of the same, or mixtures thereof with cellulosics. Preferred for many applications are nonwovens such as "TYVEK" and "SONTARA", each available from E. I. du Pont de Nemours & Company, Wilmington, Del., and "TYPAR" available from Norville Industrials, Dalton, Ga. "TYVEK" is a flash spun nonwoven fabric of polyethylene, "TYPAR" is a spun bonded nonwoven fabric of polypropylene, and "SONTARA" is a spunlaced nonwoven fabric of polyester/cellulosic.

In carpet applications, the underlays of this invention are laminated permanently to the carpeting. Suitable carpets include those wherein the pile yarns of the carpet are polyamide, polyester, polypropylene, wool, cotton, acrylic , polytrimethylene terepthalate, or mixtures thereof and other fibrous materials. For some water impermeable fabrics, merely adhering the fabric to the underside of the wall-to-wall carpeting results in a carpet with attached water impermeable backing. Some fabrics must be first treated with a water repellent and then adhered to the underside of the wall-to-wall carpeting. The methods for treating the fabric with an appropriate water repellent and curing the fabric are described for rug underlays, above. The preferred methods for adhering the fabric, whether inherently water impermeable or treated with water repellents to become water impermeable, to the wall-to-wall carpeting are either (1) applying an adhesive to the fabric in an operation separate from laminating the fabric to the underside of the wall-to-wall carpeting or (2) applying an adhesive to the fabric and/or the underside of the wall-to-wall carpeting concurrent with laminating the fabric to the underside of the wall-to-wall carpeting. Adhesives are applied to only one side of the fabric by spray, kiss-roll, or other methods known to those skilled in the art. The underlay is affixed to the primary backing of the carpet having a fabric surface tufted with pile yarns to which a latex has been applied on the underside, or to a carpet having both a primary backing and a secondary backing. The secondary backing is typically a fabric of polyester, polypropylene, cotton, jute, felt, or a thermoplastic polymer film. The preferred locations for laminating the underlay to the underside of the primary or secondary backing of the wall-to-wall carpeting are either (1) after the latexed and finished carpet has cooled but prior to roll-up or (2) during the cut-order operation when a large roll of carpet is being cut into smaller rolls to meet customer orders. The water impermeable fabric is laminated to the underside of the wall-to-wall carpet backing either manually or automatically, without the water impermeable fabric being torn, punctured, or worn to compromise its water impermeability In another embodiment of this invention, the repellent finish is applied to the underlay mat after the adhesive has been applied and dried or cured. In this embodiment, the repellent finish is chosen so as to not diminish the adhesive properties of the repellent finished underlay. In a third embodiment of this invention, the repellent finish is mixed with the adhesive and applied and dried or cured in a single operation. The repellent finish and adhesive are chosen so as to be mutually compatible and so that the repellent treatment does not diminish the adhesive properties of the repellent finished underlay. In a fourth embodiment of this invention, the repellent finish and then the adhesive, or the adhesive and then the repellent finish, is applied, followed by a single heat treatment to dry and cure both applications.

Although the repellent finishes used in this invention are similar to those used for making a carpet backing substantially impervious to liquids there are significant differences in the application of this technology to underlays. Compared to carpet, an underlay is a thinner, nonwoven fabric, without the tufted fibers or the latex binder that secures the tufted fibers in the backing. Consequently, the underlay has much less capacity to absorb liquid spills and to lower the hydrostatic pressure exerted by a liquid spill. These differences require that the repellent finish be very uniformly applied. For this reason the pad method of application, in which the underlay is immersed in a bath containing the repellent finish at the desired concentration and then squeezed to reduce the wet pick-up to the necessary level, is preferred over spray or foam applications. Spray and foam application are suitable if carefully controlled, so as to not leave small areas in which the amount of repellent finish active ingredient is inadequate to provide the imperviousness desired.

A second important difference between carpets and underlays is that the repellent finish is applied to underlays either before or after the application of the adhesive. In the case of carpets, the binding latex is applied to the primary backing before the repellent finish, else the imperviousness of the product is reduced. The binding latex must be worked into the back of the carpet, for instance by a roller, to secure the tufts. A possible explanation of this difference is that working the latex into the carpet after it has been treated with a repellent finish in this manner creates channels for liquids to pass through, thus the imperviousness is impaired.

Test Methods 1 and 2 determine the oil and water imperviousness of the underlay mats, while Test Method 3 and 4 determine oil and water repellency of the underlay mat, both after the repellent finish has been applied, dried, and cured. The oil repellency rating from Test Method 3 correlates strongly with the desired property of being substantially impervious to liquids as determined by Test Method 1. Similarly, the water repellency rating from Test Method 4 correlates strongly with the desired property of being substantially impervious to water, determined by Test Method 2. The repellency Test Methods 3 and 4 may be easier to use on certain samples. Test Methods 1 and 2 are used for the repellent finished underlay.

The present invention is further illustrated by the Test Methods and Examples below.

TEST METHODS

Test Method 1

Oil Imperviousness

The underlay sample is placed with an adhesive side down on a white absorbent paper towel. 20 ml of S.A.E. 10W30 Motor Oil, adjusted to room temperature of 24° C.+/−3° C. (75° F. +/−5° F.) is poured onto the underlay sample through a cylinder of about 4 cm diameter and from a height of about 6 cm to create a circular puddle. The cylinder is removed and the sample is not disturbed for 30 minutes. The underlay is removed and the diameter of any oil spot on the towel is measured. The sample is termed as substantially impervious to oil if none or a very slight amount of oil has passed through the underlay sample. The diameter on the paper towel of any oil spot that has passed through the underlay is measured. An oil spot diameter of 2.54 cm (one inch) or less is required for the underlay to be substantially impervious to oil.

Test Method 2

Water Imperviousness

The underlay sample is placed with an adhesive side down on a white absorbent paper towel. 20 ml of water, adjusted to room temperature of 24° C. +/−3° C. (75° F. +/−5° F.) is poured onto the underlay sample through a cylinder of about 4 cm diameter and from a height of about 6 cm to create a circular puddle. The cylinder is removed and the sample is not disturbed for 30 minutes. The underlay is removed and the diameter of any water spot on the towel is measured. The sample is termed as substantially impervious to water if none or a very slight amount of water has passed through the underlay sample. The diameter on the paper towel of any water spot that has passed through the underlay is measured. A wet spot diameter of 2.54 cm (one inch) or less is required for the underlay to be substantially impervious to water.

Test Method 3

Oil Repellency

AATCC Test Method No. 118-1989

After proper conditioning, the underlay specimen is placed on a flat level surface with an adhesive side down. Three drops of the selected oil or oil mixture are placed on the fabric and left for 30 seconds. If no penetration has occurred, the fabric is judged to "pass" this level of repellency and the next higher numbered oil mixture is tested. The fabric rating is the highest numbered oil mixture that does not wet or penetrate the fabric.

The test oil compositions are:

AATCC Oil Repellency

| Rating Number | Oil Composition |
|---|---|
| 1 | Nujol |
| 2 | 65:35::Nujol:n-hexadecane |
| 3 | n-hexadecane |
| 4 | n-tetradecane |
| 5 | n-dodecane |
| 6 | n-decane |

A rating of 0 indicates no oil repellency; a rating of 3 or higher is desired.

Test Method 4

Water Repellency

DuPont "TEFLON" Standard Test Method No. 311.56

After proper conditioning, the underlay specimen is placed on a flat level surface with an adhesive side down. Three drops of the selected water/isopropanol mixture are placed on the fabric and left for 10 seconds. If no penetration has occurred, the fabric is judged to "pass" this level of repellency and the next higher numbered test liquid is tested. The fabric rating is the highest numbered test liquid that does not wet the fabric.

The water/isopropanol mixtures have the following compositions:

| DuPont Water Repellency | Composition (wt %) | |
|---|---|---|
| Rating Number | Water | Isopropanol |
| 1 | 98 | 2 |
| 2 | 95 | 5 |
| 3 | 90 | 10 |
| 4 | 80 | 20 |
| 5 | 70 | 30 |
| 6 | 60 | 40 |

A rating of 0 indicates no water repellency, a rating of 6 indicates maximum water repellency. A test rating of 3 or higher is desired.

Control—Underlays Without a Repellent finish A needle-punched, nonwoven polyester fabric (approximately 0.14 kg/m$^2$, 4 oz./square yard) was sprayed with Air Products Pressure Sensitive Adhesive #625 on both the top and bottom face to a total wet pick-up of 20% by weight of adhesive solution. The treated fabric was dried at 132° C. (270° F.) for 3 min. resulting in a repellent finished underlay containing 10% by weight of adhesive active ingredient. The following test results were obtained using the Test Methods described above on the fabric before and after the application of the adhesive. The results for Test Metods 1 and 2 are listed in cm.

TABLE 1

Tests on Control Underlays Without Repellent finish.

| Underlay Control 1 | Imperviousness (spot diameter, cm) Oil (by Test Method 1) | Imperviousness (spot diameter, cm) Water (by Test Method 2) | Repellency Rating Oil (by Test Method 3) | Repellency Rating Water (by Test Method 4) |
|---|---|---|---|---|
| Before Adhesive Appln. | 15 or more | 25 or more | 0 | 0 |
| After Adhesive Appln. | 15 or more | 25 or more | 0 | 0 |

The control underlays failed all tests and are not substantially impervious to either water or oil.

EXAMPLES 1 TO 12

Preparation of an Underlay Sequentially Treated With a Repellent finish and Then an Adhesive, and Tests for Oil and Water Permeability.

A needle-punched, nonwoven polyester fabric (approximately 0.14 kg/m$^2$, 4 oz./square yard) was saturated with the repellent solution indicated in Table 2 and the liquid was reduced by squeezing to 200% by weight of the fabric. The treated fabric was dried at 82° C.(180° F.) for 10 min. and cured at 149° C. (300° F.) for 3 min. resulting in a fabric with the content of repellent active ingredient indicated in Table 2. The fabric was then sprayed with Air Products Pressure Sensitive Adhesive #625 (Air Products, Allentown, Pa.) on both the top and bottom face to a total wet pick-up of 20% by weight of solution. The treated fabric was dried at 132° C. (270° F.) for 3 min. to give a fabric containing 10% by weight of adhesive active ingredient. The following test results were obtained using the Test Methods described above. Results for Test Methods 1 and 2 are listed in cm.

TABLE 2

Tests on the Underlays Prepared in Example 1–12

| Example | Repellent* | Active Ingredient based on initial fabric (% by weight) | Imperviousness (spot diameter, cm) Oil (by Test Method 1) | Imperviousness (spot diameter, cm) Water (by Test Method 2) | Repellency Rating Oil (by Test Method 3) | Repellency Rating Water (by Test Method 4) |
|---|---|---|---|---|---|---|
| Fluorochemical Water-Repellent Finishes | | | | | | |
| 1 | A | 3.0% | 0 | 0 | 6 | 6 |
| 2 | B | 1.4% | 0 | 0 | 6 | 4 |

TABLE 2-continued

Tests on the Underlays Prepared in Example 1–12

| Example | Repellent* | Active Ingredient based on initial fabric (% by weight) | Imperviousness (spot diameter, cm) Oil (by Test Method 1) | Imperviousness (spot diameter, cm) Water (by Test Method 2) | Repellency Rating Oil (by Test Method 3) | Repellency Rating Water (by Test Method 4) |
|---|---|---|---|---|---|---|
| 3 | C | 1.0% | 0 | 0 | 6 | 4 |
| 4 | D | 0.30% | 0 | 0 | 6 | 6 |
| 5 | B | 3.0% | 0 | 0 | 6 | 5 |
| 6 | FC-1355 | 1.5% | 0 | 0 | 5 | 5 |
| 7 | FC-1367 | 1.5% | 0 | 0 | 6 | 5 |
| Mixed Fluorochemical and Hydrocarbon Water-Repellent Finishes | | | | | | |
| 8 | E | 2.4% | 0 | 0 | 6 | 6 |
| 9 | F | 0.96% | 0 | 0 | 6 | 6 |
| Hydrocarbon Water-Repellent Finish | | | | | | |
| 10 | G | 1.2% | 15 | 0 | 0 | 5 |
| 11 | H | 1.2% | 15 | 0 | 0 | 4 |
| 12 | Octowax 321 | 2.5% | 18 | 0 | 0 | 5 |

The tests showed the underlay treated with repellents G and H as well as Octowax 321 were substantially impervious to water, all other treated underlays were substantially impervious to oil and water.

*The repellent finishes used were as follows:

A—polyfluoro organic compound prepared by reacting a polyisocyanate with a fluoroalcohol and water as disclosed in EP A 453641.

B—blend of fluoroalkyl citrate—urethane and polymethylmethacrylate disclosed in U.S. Pat. No. 3,923,715.

C—fluorocarbonylimino fuiret prepared by reacting polyisocyanate with fluoroalcohol and monochlorohydrin disclosed in U.S. Pat. No. 4,958,039.

D—a blend of a fluoroalkyl citrate urethane, a fluoroalkyl methacrylate/2-ethylhexyl methacrylate/2-hydroxyethyl meth-acrylate/N-methylolacrylamide copolymer, a fluoroalkyl methacrylate/lauryl meth-acrylate/N-methylolacrylamide copolymer, a dimethylaminoethyl methacrylate/acrylic acid copolymer, and a chloroprene/dichlorobutadiene copolymer disclosed in U.S. Pat. No. 4,595,518.

F3-1355—aniomic emulsion of fluoroaliphatic polymers available as FC-1355 from 3M, Minneapolis, Minn.

FC-1367—anionic emulsion of fluoroaliphatic polymers available as FC-1367 from 3M, Minneapolis, Minn.

E—a fluoroalkyl acrylate/hexadecyl methacrylate/octadecyl methacrylate/vinylidene chloride copolymer disclosed in U.S. Pat. No. 4,742,140.

F—a blend of wax, a diethylaminoethyl methacrylate/hexadecyl methacrylate/ocradecyl methacrylate copolymer and a fluoroalkyl methacrylate copolymer of the type disclosed in U.S. Pat. No. 4,595,518.

G—aqueous dispersion of: a hydrocarbon wax and a behenic acid ester of melamine.

H—a hydrocarbon wax stearyl methacrylate/diethylaminoethyl methacrylate copolymer.

EXAMPLES 13–19

Preparation of an Underlay Sequentially Treated With an Adhesive and Then a Repellent finish, and Tests for Oil and Water Permeability.

A needle-punched, nonwoven polyester fabric (approximately 0.14 kg/m$^2$, 4 oz./square yard) was sprayed with Air Products Pressure Sensitive Adhesive #625 (Air Products, Allentown, Pa.) on both the top and bottom face to a total wet pick-up of 20% by weight of solution. The treated fabric was dried at 132° C. (270° F.) for 3 min. to give a fabric containing 10% by weight of adhesive active ingredient. The fabric was then saturated with a water-repellent solution and the liquid was reduced by squeezing to 200% by weight of the fabric. The treated fabric was dried at 82° C. (180° F.) for 10 min. and cured at 149° C. (300° F.) for 3 min. resulting in a fabric with the content of repellent active ingredient indicated in Table 3. The following test results were obtained using the Test Methods described above. The results for Test Methods 1 and 2 are in cm. Repellent finishes A to G were as defined in Examples 1–12.

TABLE 3

Tests on the Underlays Prepared in Example 13–19

| Example | Repellent | Active Ingredient based on initial fabric (% by weight) | Imperviousness (spot diameter, cm) Oil (by Test Method 1) | Imperviousness (spot diameter, cm) Water (by Test Method 2) | Repellency Rating Oil (by Test Method 3) | Repellency Rating Water (by Test Method 4) |
|---|---|---|---|---|---|---|
| Fluorochemical Water-Repellent Finishes | | | | | | |
| 13 | A | 3.0% | 0 | 0 | 6 | 5 |
| 14 | C | 1.0% | 0 | 0 | 6 | 5 |
| 15 | D | 0.30% | 0 | 0 | 6 | 6 |
| 16 | B | 3.0% | 0 | 0 | 6 | 6 |
| Mixed Fluorochemieal and Hydrocarbon Water-Repellent Finishes | | | | | | |
| 17 | E | 1.2% | 0 | 0 | 6 | 6 |
| 18 | F | 0.96% | 0 | 0 | 6 | 6 |
| Hydrocarbon Water-Repellent Finish | | | | | | |
| 19 | G | 1.2% | 15 | 0 | 0 | 4 |

The tests showed that the underlay treated with Repellent G was substantially impervious to water, all other treated underlays were substantially impervious to oil and water.

EXAMPLES 20–22

Preparation of Underlays Sequentially Treated With a Repellent finish and Then an Adhesive, Followed by a Combined Drying and Curing Treatment, and Tests for Oil and Water Permeability.

A needle-punched, nonwoven polyester fabric (approximately 0.14 kg/m$^2$, 4 oz./square yard) was saturated with the indicated repellent solution and the liquid was reduced by squeezing to 200% by weight of the fabric. The fabric was then sprayed with Air Products Pressure Sensitive Adhesive #625 (Air Products, Allentown, Pa.) on both the top and bottom face to a total wet pick-up of 200% by weight of solution. The treated fabric was dried at 132° C. (270° F.) for 3 min. to give a fabric containing about 25% by weight of adhesive active ingredient and with the content of repellent active ingredient indicated in Table 4. The following test results were obtained using the Test Methods described above. The results for Test Methods 1 and 2 are in cm. Repellent finishes D, F and G were as defined in Examples 1–12.

TABLE 4

Tests on the Underlays Prepared in Example 20–22

| Example | Repellent | Active Ingredient based on initial fabric (% by weight) | Imperviousness (spot diameter, cm) Oil (by Test Method 1) | Imperviousness (spot diameter, cm) Water (by Test Method 2) | Repellency Rating Oil (by Test Method 3) | Repellency Rating Water (by Test Method 4) |
|---|---|---|---|---|---|---|
| Fluorochemical Repellent Finish | | | | | | |
| 20 | D | 0.30% | 0 | 0 | 6 | 6 |
| Mixed Fluorochemical and Hydrocarbon Repellent Finishes | | | | | | |
| 21 | F | 0.95% | 15 | 0 | 2 | 6 |
| Hydrocarbon Water-Repellent Finish | | | | | | |
| 22 | G | 2.5% | 15 | 0 | 0 | 5 |

The tests showed the underlays treated with Repellents F and G were substantially impervious to water. The underlay treated with Repellent D was substantially impervious to oil and water.

EXAMPLES 23–62

Examples 23–62 demonstrated the application of water impervious underlay fabrics to carpet and were compared with a control sample of the carpet without the impermeable underlay. The water impervious underlays used are listed on Table 5. Examples 24–26 were "TYPAR" available from Norville Industrials, Dalton, Ga. Example 27 was "TYVEK" available from E. I. du Pont de Nemours and Company, Wilmington, Del. Example 28 was a commercially available melt blown polypropylene nonwoven fabric. Examples 29–38 were "SONTARA" available from E. I. du Pont de Nemours & Co., Wilmington, Del. Examples 39–46 were nonwoven fabrics RB 400 (130 g/m$^2$) and RB 406 (150g/m2) obtained from Synthetic Industries, Ringold, Ga. Examples 47–62 were various commercially available woven and knit fabrics purchased in Walmart in Chattanooga, Tenn. Some fabrics did not require oil or water repellent treatments and others were treated with a repellent as listed in Table 5. Repellents D and E as defined in Examples 1–12 were employed. Both are available from E. I. du Pont de Nemours & Company, Wilmington, Del.

For treating the underlay, the chemicals were spray applied, and the underlay fabric was dried at 82° C. (180° F.) and cured at 148° C. (300° F.) for 3 min. The water impervious underlays were adhered to the underside of the wall-to-wall carpeting using 3M Super 77 Spray Adhesive available from 3M Company, St. Paul, Minn. and applying a coating to both the fabric and the underside of the carpeting by spraying each surface for 15–20 seconds before laminating the two surfaces according to the directions on the adhesive package. For all Examples 23–62 the underlays were affixed to carpet from Coronet Mills, Dalton Ga., style name "Torrey Pines Plus", 1.02 kg/m$^2$ (30 oz/yd$^2$) nylon carpet treated with DuPont's "STAINMASTER" stain and soil resists. For Examples 38, 42, and 46 the underlay was sprayed with the adhesive, affixed to the underside of the carpet, and then treated with repellent, followed by drying and curing as noted above. The water imperviousness, oil repellency, and water repellency tests, Test Methods 2 through 4 as previously described, were conducted on the carpet samples. The resulting data are summarized in Table 5. Results for test Method 2 are in cm.

TABLE 5

| Ex. # | Attached Underlay Fabric | Repellent Treatment | Test Method #2 | #3 | #4 |
|---|---|---|---|---|---|
| 23 | none (carpet control) | none | 25+ | 0 | 0 |
| 24 | Polypropylene, Spunbonded nonwoven, 150 g/m² | none | 0 | 0 | 4 |
| 25 | Polypropylene Spunbonded nonwoven 120 g/m² | none | 0 | 0 | 4 |
| 26 | Polypropylene Spunbonded nonwoven 110 g/m² | none | 0 | 0 | 4 |
| 27 | Polyethylene Flash spun nonwoven 40 g/m² | none | 0 | 0 | 4 |
| 28 | Polypropylene Melt blown nonwoven 70 g/m² | none | 0 | 0 | 4 |
| 29 | Polyester/cellulosic spunlaced nonwoven 78 g/m² | none | 25+ | 0 | 0 |
| 30 | Polyester/cellulosic spunlaced nonwoven 78 g/m² | E 65 g/m² | 0 | 0 | 6 |
| 31 | Polyester/cellulosic spunlaced nonwoven 78 g/m² | E 130 g/m² | 0 | 6 | 6 |
| 32 | Polyester, spunlaced nonwoven 110 g/m² | none | 25+ | 0 | 1 |
| 33 | Polyester Spunlaced non woven, 110 g/m² | E 65 g/m² | 0 | 4 | 6 |
| 34 | Polyester Spunlaced nonwoven 130 g/m² | none | 25+ | 0 | 0 |
| 35 | Polyester Spunlaced nonwoven 130 g/m² | E 65 g/m² | 0 | 6 | 6 |
| 36 | Polyester Spunlaced nonwoven 130 g/m² | none | 25+ | 0 | 1 |
| 37 | Polyester Spunlaced nonwoven 130 g/m² | E 65 g/m² | 0 | 4 | 6 |
| 38 | Polyester Spunlaced nonwoven 130 g/m² | D 100 g/m² | 0 | 6 | 6 |
| 39 | Polypropylene needle punched nonwoven, 150 g/m² | none | 25+ | 0 | 1 |
| 40 | Polypropylene needle punched nonwoven 150 g/m² | E 65 g/m² | 0 | 6 | 6 |
| 41 | Polypropylene needle punched nonwoven, 150 g/m² | E 130 g/m² | 0 | 6 | 6 |
| 42 | Polyester needle punched nonwoven 130 g/m² | D 100 g/m² | 0 | 6 | 6 |
| 43 | Polyester needle punched nonwoven, 130 g/m² | none | 25+ | 0 | 0 |
| 44 | Polyester needle punched nonwoven 130 g/m² | E 65 g/m² | 0 | 6 | 6 |
| 45 | Polyester needle punched nonwoven 130 g/m² | E 130 g/m² | 0 | 6 | 6 |
| 46 | Polyester needle punched nonwoven 130 g/m² | D 100 g/m² | 0 | 6 | 6 |
| 47 | Woven 65% polyester/35% cotton 100 g/m² | none | 25+ | 0 | 0 |
| 48 | Woven 65% polyester/35% cotton 100 g/m² | D 100 g/m² | 0 | 5 | 6 |
| 49 | Knitted, acrylic 180 g/m² | none | 25+ | 0 | 0 |
| 50 | Knitted, acrylic 180 g/m² | D 100 g/m² | 0 | 6 | 6 |

TABLE 5-continued

| Ex. # | Attached Underlay Fabric | Repellent Treatment | Test Method #2 | #3 | #4 |
|---|---|---|---|---|---|
| 51 | Knitted, acetate 110 g/m² | None | 25+ | 0 | 0 |
| 52 | Knitted, acetate 110 g/m² | D 100 g/m² | 0 | 6 | 6 |
| 53 | Knitted, polyester 100 g/m² | none | 25+ | 0 | 0 |
| 54 | Knitted, polyester 100 g/m² | D 100 g/m² | 0 | 6 | 6 |
| 55 | Knitted, 85% nylon/15% Lycra-Spandex 160 g/m² | none | 25+ | 0 | 3 |
| 56 | Knitted, 85% nylon/15% Lycra-Spandex 160 g/m² | D 100 g/m² | 0 | 6 | 6 |
| 57 | Woven, cotton 140 g/m² | none | 25+ | 0 | 0 |
| 58 | Woven, cotton 140 g/m² | D 100 g/m² | 0 | 6 | 6 |
| 59 | Woven, wool 260 g/m² | none | 25+ | 0 | 3 |
| 60 | Woven, wool 260 g/m² | D 100 g/m² | 0 | 6 | 6 |
| 61 | Woven, nylon 100 g/m² | none | 25+ | 0 | 0 |
| 62 | Woven, nylon 100 g/m² | D 100 g/m² | 0 | 5 | 6 |

What is claimed is:

1. A tufted pile carpet comprising:

a) a primary backing having a surface tufted with pile yarns and an underside to which a water permeable latex has been applied;

b) an optional water permeable secondary backing having a surface and an underside, wherein the surface of the secondary backing is adhered to the underside of the primary backing; and c) an underlay having a surface and an underside, wherein the surface of said underlay is coated with a pressure sensitive adhesive which cures at ambient temperature and affixed to the underside of either the secondary backing or the primary backing, and said underlay comprises a nonlatex fabric, said fabric being substantially impervious to liquids, wherein said carpet is substantially impervious to liquids.

2. The carpet of claim 1 wherein the underlay is polyester, polyolefin, polytrimethylene terephthalate, nylon, wool, cotton, acrylic, jute, mixtures thereof, or mixtures with a cellulosic.

3. The carpet of claim 1 wherein the adhesive used to affix the underlay provides a lamination strength of at least 8.9 kg/m.

4. The carpet of claim 1 wherein the adhesive adheres the undelay to the primary or secondary backing immediately upon contact.

5. The carpet of claim 1 wherein the adhesive remains adhered to the underlay and the primary or secondary backing when wet by liquid.

6. The carpet of claim 1 wherein the pile yarns are polyamide, polyester, polyolefin, polytrimethylene terephthalate, wool, cotton, acrylic, or mixtures thereof.

7. The carpet of claim 1 wherein the underlay has in or on it a repellent finish comprising a fluorochenmical, silicone, wax emulsion, naturally occurring oil, alkylacrylate resin, hydrophobic alkylmethacrylate resin, or a mixture thereof.

8. The carpet of claim 7 wherein said fluorochemicals are selected from the group consisting of polyvinylidene fluoride; polytetrafluoroethylene; perfluoroalkylethyl acrylates; perfluoroalkylethyl methacrylates; mixtures of the same; and blends of the foregoing compounds and polymers with polyalkyl acrylates, polyalkylmethacrylates, wax emulsions, and copolymers of vinylidene chloride, vinylidene fluoride, tetrafluoroethylene, perfluoroalkylethyl acrylates, and perfluoroalkylethyl methacrylates.

9. The carpet of claim 7 wherein said fluorochemical is selected from the group consisting of fluoroalkyl citrate urethane, a fluoroalkyl methacrylate/2-ethylhexyl methacrylate/2-hydroxyethyl methacrylate/N-methylolacrylamide copolymer, a fluoroalkyl methacrylate/lauryl methacrylate/N-metholacrylamide copolymer, a dimethylaminoethyl methacrylate/acrylic acid copolymer, a chloroprene/dichlorobutadiene copolymer, and a blend thereof.

* * * * *